US012808184B2

(12) United States Patent
Jing et al.

(10) Patent No.: US 12,808,184 B2
(45) Date of Patent: Nov. 24, 2026

(54) SOUND ABSORBING PANELS

(71) Applicant: The Penn State Research Foundation, University Park, PA (US)

(72) Inventors: Yun Jing, University Park, PA (US); Jun Ji, University Park, PA (US)

(73) Assignee: THE PENN STATE RESEARCH FOUNDATION, University Park, PA (US)

( * ) Notice: Subject to any disclaimer, the term of this patent is extended or adjusted under 35 U.S.C. 154(b) by 223 days.

(21) Appl. No.: 18/705,355

(22) PCT Filed: Oct. 28, 2022

(86) PCT No.: PCT/US2022/048208
§ 371 (c)(1),
(2) Date: Apr. 26, 2024

(87) PCT Pub. No.: WO2023/076587
PCT Pub. Date: May 4, 2023

(65) Prior Publication Data

US 2024/0417972 A1 Dec. 19, 2024

Related U.S. Application Data

(60) Provisional application No. 63/273,695, filed on Oct. 29, 2021.

(51) Int. Cl.
*E04B 1/86* (2006.01)
*E04B 1/84* (2006.01)

(52) U.S. Cl.
CPC ..... *E04B 1/86* (2013.01); *E04B 2001/8433* (2013.01)

(58) Field of Classification Search
CPC ..... E04B 1/86; E04B 2001/8433
(Continued)

(56) References Cited

U.S. PATENT DOCUMENTS

D704,454 S * 5/2014 Kuehn ..... D5/62
8,733,500 B1 * 5/2014 Ayle ..... F02C 7/24 181/292

(Continued)

FOREIGN PATENT DOCUMENTS

JP 2008-009014 A 1/2008
KR 20-0380478 Y1 3/2005
KR 10-1785969 B1 10/2017

OTHER PUBLICATIONS

International Search Report and Written Opinion mailed Mar. 7, 2023 in related International Patent Application No. PCT/US2022/048208.

*Primary Examiner* — Forrest M Phillips
(74) *Attorney, Agent, or Firm* — Troutman Pepper Locke LLP

(57) ABSTRACT

A sound absorbing panel includes a cavity section having a plurality of resonant cavities and a front panel having a plurality of sets of openings. Each set of openings is configured to provide fluid communication between one of the plurality of resonant cavities and the environment. Each of the plurality of resonant cavities has different dimensions from the remaining plurality of resonant cavities such that each of the resonant cavities is tuned for a different frequency range. Each of the sets of openings can differ from the remaining sets of openings in opening size, length, and distance between openings.

15 Claims, 5 Drawing Sheets

(58) Field of Classification Search
USPC ..... 181/290
See application file for complete search history.

(56) References Cited

U.S. PATENT DOCUMENTS

| | | | | |
|---|---|---|---|---|
| 10,978,036 | B2 * | 4/2021 | Kim | G10K 11/168 |
| 11,131,456 | B2 * | 9/2021 | Dyszkiewicz | F23M 20/005 |
| 11,629,644 | B2 * | 4/2023 | Versaevel | G10K 11/172 181/292 |
| D1,021,155 | S * | 4/2024 | Gandhe | D25/152 |
| 2005/0098379 | A1 | 5/2005 | Sato et al. | |
| 2015/0122577 | A1 * | 5/2015 | Zalewski | G10K 11/172 181/290 |
| 2019/0063318 | A1 | 2/2019 | Roach et al. | |

* cited by examiner

| Frequency range of interest | Estimated depth |
|---|---|
| 56 - 112 Hz (average absorption 90%) | 21cm |
| 112 - 224 Hz (average absorption 90%) | 15cm |
| 224 - 448 Hz (average absorption 90%) | 10cm |

SOUND ABSORBING PANELS

CROSS REFERENCE TO RELATED APPLICATIONS

This application is a national phase filing under 35 U.S.C. § 371 of International Application Serial No. PCT/US2022/048208, filed Oct. 28, 2022, which claims the benefit of U.S. Provisional Application Ser. No. 63/273,695 titled "Sound Absorbing Panels" filed Oct. 29, 2021, each of which is hereby incorporated herein by reference in its entirety.

FIELD

The present disclosure relates to acoustic energy absorption structures. Embodiments may be further suited to structures that exhibit high efficiency acoustic energy absorption over a broad frequency range from 20 Hz to 6 kHz.

BACKGROUND

A sound absorber with a broadband and high absorption at a deep-subwavelength scale is of great interest in many fields, such as room acoustics, automobiles, and aerospace engineering. The emergence of acoustic metamaterials and acoustic meta-surfaces has enabled novel methods to design acoustic functional devices and has facilitated the development of new sound absorbing structures. To achieve the deep-subwavelength scale, one strategy is to use a very thin decorated membrane. In such a design, however, a uniform and controlled tension of the membranes is needed, which leads to fabrication challenges and durability issues. Another strategy is to modify the geometry of the conventional Helmholtz resonator (HR) and the micro-perforated panel (MPP) into space-coiling structures, embedded-neck structures, or multi-coiled structures. Under the condition of impedance match or critical coupling, these designs can achieve a perfect sound absorption. Both the strategies above, however, have relatively narrow absorption bandwidth, which inevitably hinders practical applications. Some designs improve the bandwidth of single/identical resonator by tailoring the damping, such as increasing the intrinsic material damping or utilizing a heavily overdamped condition. Such designs, however, are either impractical or can hardly be applied to airborne sound absorption without an impractically thick panel.

SUMMARY

A sound absorbing panel comprises of a veneer with non-uniform openings and a back panel with different sized cavities, which can include space-coiled cavities. The openings in the veneer have different shapes, sizes, or arrangements, which are determined from a desired absorption spectrum. The back panel is composed of space-coiled cavities with different volumes. The openings and the associated space-coiled cavity form a unit cell to collectively absorb noise with a certain range of frequency. Different unit cells are combined to create a super cell, which provides a plurality of resonant modes for broadband sound absorption. The combined super cell structure can achieve broader frequency ranges of high acoustic absorption within a specific thickness thinner than structures of conventional Helmholtz resonators and conventional micro-perforated panel.

According to one embodiment, a sound absorbing panel comprises a cavity section having a plurality of resonant cavities and a front panel having a plurality of sets of openings. Each set of openings is configured to provide fluid communication between one of the plurality of resonant cavities and the environment. Each of the plurality of resonant cavities has different dimensions from the remaining plurality of resonant cavities such that each of the resonant cavities is tuned for a different frequency range.

According to one embodiment, a sound absorbing panel comprises at least one group of sound absorbing cells and a front panel having a plurality of sets of openings. Each cell within the group comprises a resonant cavity with predetermined dimensions. Each set of openings corresponds to a sound absorbing cell and is configured to provide fluid communication between the resonant cavity of the cell and the environment. The resonant cavity of each of the plurality of sound absorbing cells in the group has different dimensions from the remaining plurality of resonant cavities such that each of the resonant cavities in the group is tuned for a different frequency range.

According to one embodiment, a sound absorbing panel comprises a cavity section having a plurality of resonant cavities, a front panel having a plurality of sets of openings, and a back panel that otherwise isolates the plurality of resonant cavities from the environment. Each set openings is configured to provide fluid communication between one of the plurality of resonant cavities and the environment. The panel is divided into at least one group of sound absorbing cells, where each cell comprises one of the resonant cavities and one of the plurality of sets of openings. The resonant cavity of each of the plurality of sound absorbing cells in the group has different dimensions from the remaining plurality of resonant cavities such that each of the resonant cavities in the group is tuned for a different frequency range.

In some embodiments, each of the sets of openings differs from the remaining sets of openings in at least one of opening size, length, and distance between openings. In some embodiments, at least one of the plurality of resonant cavities comprises outer walls and at least one baffle such that the resonant cavity is coiled. In some embodiments, the resonant cavity is coiled parallel to a plane defined by the front panel. In some embodiments, the resonant cavity is coiled perpendicular to a plane defined by the front panel.

DETAILED DESCRIPTION

Embodiments achieve broadband absorption by creating many resonances in a given frequency range. The disclosed techniques can provide high-efficiency acoustic energy absorption over a broadband frequency range.

An exemplary broadband sound absorbing panel includes periodic super cells that each include a plurality of unit cells, which each absorb a partial frequency band of noise. The frequency response of the super cell is a sum of the frequency bands of the unit cells.

Figure 1B:
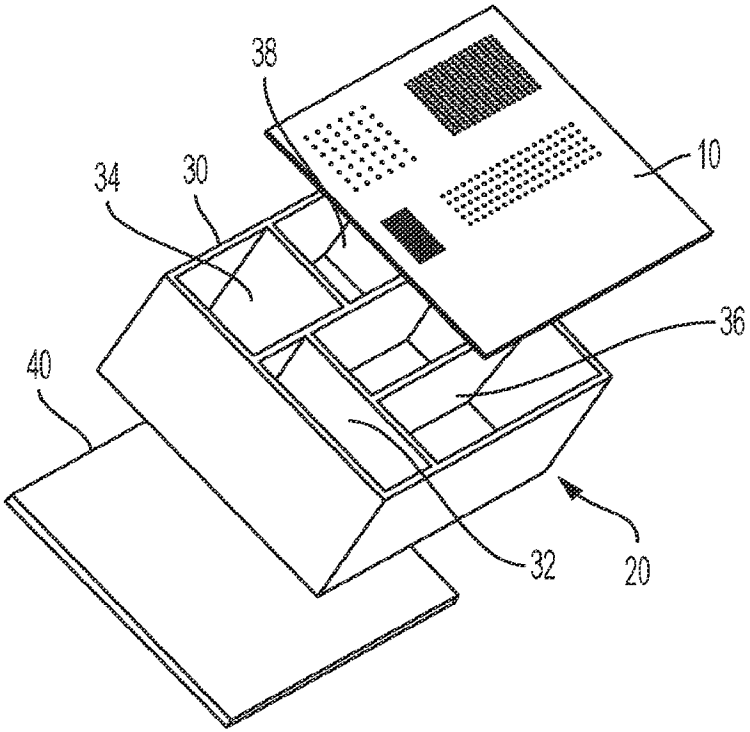
FIG. 1B is an exploded view of a section or super cell of an exemplary embodiment of a sound-absorbing panel.
Figure 1A:
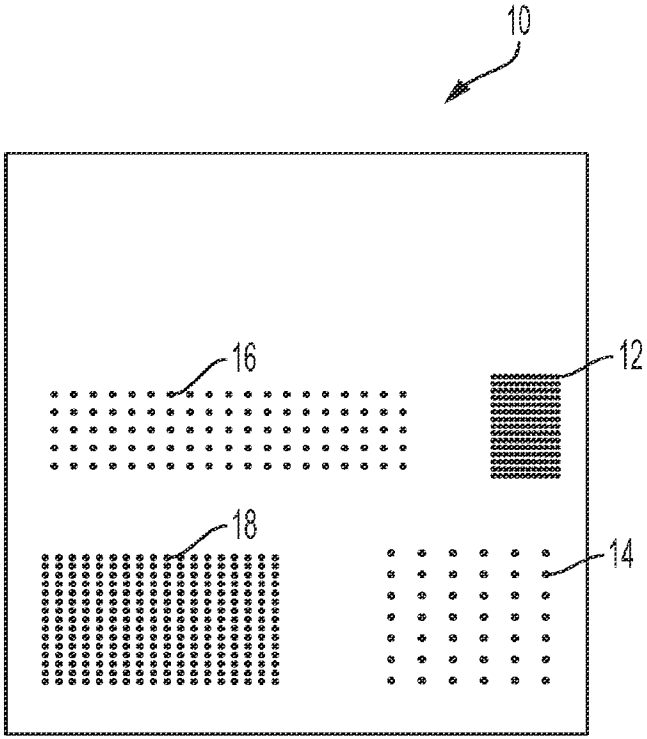
FIG. 1A is a front view of a section or super cell of an exemplary embodiment of a sound-absorbing panel.

Each unit cell of the super cell includes openings drilled throughout the veneer and an air cavity connected to them. In some embodiments, Neither the openings within each unit cell nor the openings in different unit cells need be the same size. Each unit cell includes at least one through opening, which allows the back cavity to be in fluid communication with the environment through the opening(s). FIG. 1A is a front view of an exemplary veneer panel that provides the face for a sound absorbing panel. It should be noted that embodiments of sound absorbing panels can have an array of super cells, such that the panel thickness is much smaller than the extents of the planar face of the panel. The examples shown in these figures include a single super cell (having a plurality of unit cells/resonant chambers), which may give the incorrect impression that all embodiments of these panels are relatively thick compared to the size of the panel. Embodiments can have any suitable number of supercells in the panel to suit the needs of the application. Veneer panel 10 includes a plurality of groupings of openings (12, 14, 16, 18), each grouping associated with a single unit cell, together forming a super cell. In this example, there are four-unit cells in a single super cell. Each grouping of openings includes two primary attributes in this example, hole size and the distance between the holes. For example, the holes in grouping 12 are much smaller and have a tighter pitch than the holes in grouping 16. More about the choice of hole size and pitch for groups of openings will be discussed later. While the openings in FIG. 1A are round, any shape can be used. In FIG. 1A, the opening sizes vary to correspond to a desired frequency-band absorption, which can be as large as that of conventional Helmholtz resonators or as small as that of conventional micro-perforated panels.

The openings in the veneer panel 10 provide fluid communication between the environment and a resonant cavity behind each group of openings. The arrangement of the veneer relative to the resonant cavities is illustrated in the exemplary exploded view shown in FIG. 1B. Panel super cell 20 includes veneer panel 10, which is placed in front of 3-dimensional cavity section 30, which is coupled to backer panel 40, which isolates the cavity section 30 from the environment other than through front panel 10. Veneer 10, cavity section 30, and backer panel 40 provide all the sides for resonant cavities that are in fluid communication with the environment through the openings in veneer 10. The air cavity within each unit cell is sealed by the partition between unit cells and the front veneer to form the required resonance so that absorption can be enhanced. While the cavities in FIG. 1B are rectangular cavities, any suitable shape can be used, such as cylindrical, conical, spherical, ovoid, or any other shape that is suitable to form an enclosed cavity. Cavity section 30 and backer panel 40 can be constructed of any suitable rigid material and process. For example, backer panel 40 and cavity section 30 can be formed from wooden sheet materials using any suitable joinery method, such as glue, fasteners, dowels, tenons, biscuits, dovetails, rabbets, etc. In some environments, cavity section 30 and backer panel 40 can be a monolithic material that is molded or 3D printed. In some embodiments, veneer panel 10 can also be monolithically integrated with cavity section 30 through a molding or 3D printing process. In some embodiments, the geometry of cavity section 30 comprises intersecting flat planes, such as shown in FIG. 1B. In some embodiments, the walls or baffles making up the cavities of the cells need not be planar. In this example, cavities 32, 34, 36, 38 are in fluid communication with groups of openings 12, 14, 16, and 18, respectively. Note that the shapes of these cavities are generally rectangular in nature, but the aspect ratios and sizes vary. In the case of cavity 36, the cavity is a rectilinear U-shape, with a baffle that subdivides the rectangular cavity, making the resonator act like much longer, coiled chamber. Any number of unit cells can be coiled using baffles or straight, depending on the application.

Figure 1D:
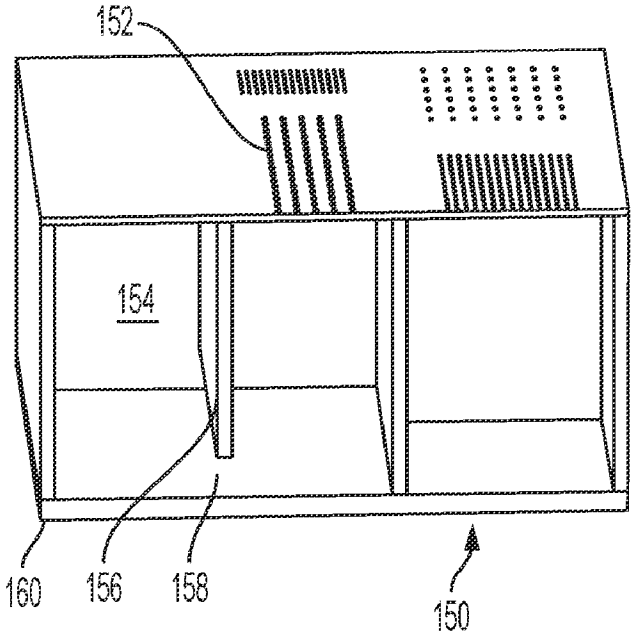
FIG. 1D is a perspective view of a section or super cell of an exemplary embodiment of a sound-absorbing panel.
Figure 1C:
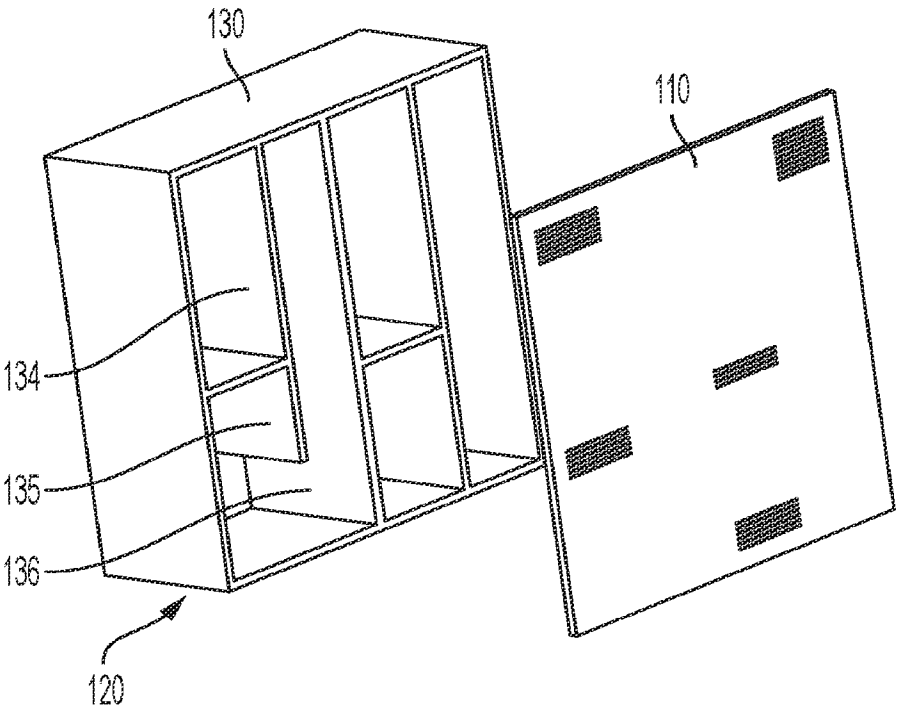
FIG. 1C is an exploded view of a section or super cell of an exemplary embodiment of a sound-absorbing panel.

FIG. 1C shows an exploded view of another exemplary embodiment (backer plate not shown). In this example, veneer plate 110 has five sets of openings corresponding to five chambers of different sizes behind the veneer in cavity section 130. This view illustrates how baffles can be used to produce longer resonator cavities in a compact manner that are interspersed with shorter resonator cavities. Resonator cavity 134 has a rectangular profile. Meanwhile, by virtue of baffle 135, resonator cavity 136 is approximately three times the length of resonator cavity 134 due to its coiled, J-shaped profile.

FIG. 1D is a cutaway of another embodiment featuring a coiled resonator cavity. Sound absorbing panel 150 includes resonator cavity 154 which communicates with the surrounding environment through openings 152. In this example, cavity 154 is a coiled cavity, but unlike the example in FIG. 1C, it is coiled perpendicular to the plane of the panel face. Specifically, baffle 156 does not protrude all the way to backer plate 160, creating passage 158 which creates an effective length of cavity 154 that is roughly twice the thickness of panel 150.

In some embodiments, the volume of the resonant cavity can be varied to achieve a desired resonant effect. The resonant properties of each cell are determined by the characteristics of the cavity geometry and the size and arrangement of the openings into the cavity. In some implementations, both the aperture sizes and cavity volumes can be varied simultaneously to provide even better control of the frequency absorption.

One non-limiting example of sound absorption is given, which is targeted toward audio frequencies 224 Hz-447 Hz. It is understood that other frequency ranges may be targeted, including those below 224 Hz and sub-audible frequencies, as well as frequencies above 447 Hz.

FIGS. 1A, 1B, and 1D show an implementation of a sound absorbing panel. The panel has four cavities, a veneer, and a back plate. In FIG. 1A, the veneer has four groups of openings. The top-left group (16) has 95 openings, each being 1 mm in diameter. The top-right group (12) has 180 openings, each being 0.65 mm in diameter. The bottom-left group (18) has 270 openings, each being 0.75 mm in diameter. The bottom-right (14) group has 42 openings, each being 1.05 mm in diameter. The cavities, as shown in FIG. 1B, are rectangular-shaped. One of the cavities 154, as shown in FIG. 1D, is space-coiled.

To better illustrate the sound absorbing panel, start from the case where plane incident wave along z-axis p normally impinges on the assumed sound absorbing panel. The sound absorbing system could be fully characterized by its normalized surface impedance $Z_S$. The absorption coefficient can be calculated by Equation 1

$$\alpha = \frac{4\mathrm{Re}(Z_s)\rho_0 c_0}{\{\rho_0 c_0 + \mathrm{Re}(Z_s)\}^2 + \{\mathrm{Im}(Z_s)\}^2}, \quad \text{[Equation 1]}$$

$\rho_0 c_0$=413.3 Pa·s/m is the characteristic acoustic impedance of air. Re denotes the real part and Im denotes the imaginary part. The coefficients and variables are explained in Tables 1 and 2.

When the panel is composed of M different unit cells in parallel, its absorption performance can be characterized by a mean specific acoustic admittance or a mean specific acoustic impedance at normal incidence, $$\frac{1}{Z_s} = \sum_1^M \frac{\phi_N}{Z_N}, \quad \text{[Equation 2]}$$

$Z_N$ is the specific acoustic impedance for resonator, and $\phi_N$ is the surface porosity.

$$\phi_N = A_N \pi \left(\frac{d_N}{2}\right)^2 \Big/ D^2 \quad \text{[Equation 3]}$$

$A_N$ is the number of openings in unit cell N. $d_N$ is the diameter of the openings. D is the side length of the super cell. Here the openings in each unit cells are assumed to be the same.

The Stinson's model, which is valid for a broad range of frequencies, can be used to model the narrow neck with the visco-thermal loss effect considered. Therefore, we have the impedance for the cylindrical neck with a circular cross-section, $$Z_n = -\frac{\rho_0 c_0}{p} \frac{2j\sin\left(\frac{k_c l_n}{2}\right)}{\sqrt{(\gamma-(\gamma-1)\psi_h)\psi_v}}, \quad \text{[Equation 4]}$$

$\rho_0$, $c_0$ and $\gamma$ are density, speed of sound and the ratio of specific heats of air. The values are taken as 1.21 kg/m$^3$, 343.2 m/s and 1.4.

$$k_c = k\sqrt{\frac{\gamma-(\gamma-1)\psi_h}{\psi_v}}, \ \psi_v = \frac{J_2(k_v d/2)}{J_0(k_v d/2)} \text{ and } \psi_h = \frac{J_2(k_h d/2)}{J_0(k_h d/2)} \quad \text{[Equation 5]}$$

These refer to the complex wave number, the viscous function and the thermal function of the embedded neck. $k_v$ and $k_h$ the viscous wave number and the thermal wave number:

$$k_v^2 = -j\omega\frac{\rho_0}{\eta}, \ k_h^2 = -j\omega\frac{\rho_0 C_p}{K}. \quad \text{[Equation 6]}$$

$\eta$, $C_p$ and K are the dynamic viscosity of air, the specific heat at constant pressure and the fluid thermal conductivity, of which the values are taken as $1.825\times10^{-5}$ kg/(m·s), 1007 J/(kg·K) and 0.02514 W/(m·K). $l_n$ is length of the opening.

$$p = A\pi\left(\frac{d_N}{2}\right)^2 \Big/ S \quad \text{[Equation 7]}$$

S is the cross-sectional area of the cavity. The impedance for the cavity can be approximated as $$Z_c = -j\cot(kl_{c,eff}), \quad \text{[Equation 8]}$$

$l_{c,eff}$ is the effective length of the cavity. $l_{c,eff}$ is the depth of cavity when the cavity is not space coiled. $l_{c,eff}$ can be retrieved from numerical simulations (e.g., COMSOL Multiphysics) if the cavity is space coiled.

The overall impedance of the resonator can be approximated as the sum of the impedances of the opening and the cavity, which reads, $$Z = Z_n + Z_c, \quad \text{[Equation 9]}$$

The subscript n represents the openings and c represents the cavity.

Figure 2:
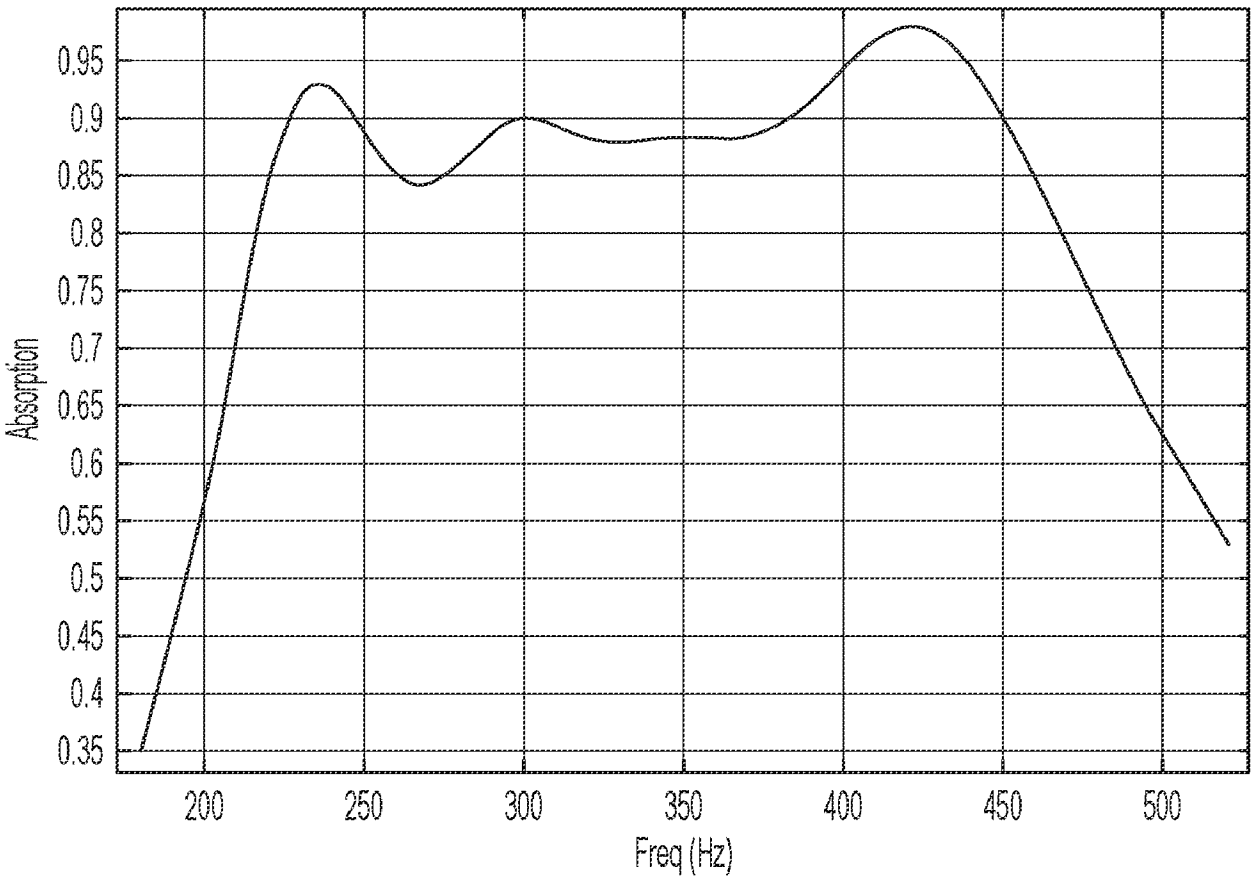
FIG. 2 is a frequency response graph of acoustic absorption proper ties of the sound-absorbing panel of FIGS. 1A, 1B and 1C.

FIG. 2 shows acoustic absorption results for the acoustic absorber of FIGS. 1A, 1B and 1D, which has four configurations of unit cells, each tuned to a different resonance peak. The average absorption coefficient between 224-447 Hz is 90%.

In some embodiments, the length of openings can be extended into the corresponding cavity to further shrink the veneer thickness while maintaining the absorption performance. For example, a tube can be placed inside of a hole in the veneer to extend the narrow length of the opening to provide additional characteristics that can be manipulated to tune a resonant chamber to a desired response. An extension of openings can be realized by either an elastic or a non-elastic hollow tube. The tube can be any solid material, such as wood, metal, plastic, composite, etc. The tube can be either straight or curved. In some embodiments the tubes may slip into holes in a veneer or may be molded or coupled to the front veneer panel using any suitable manufacturing process, such as a molded array of tubes that can be fastened to a larger gap in the veneer.

Figure 3:
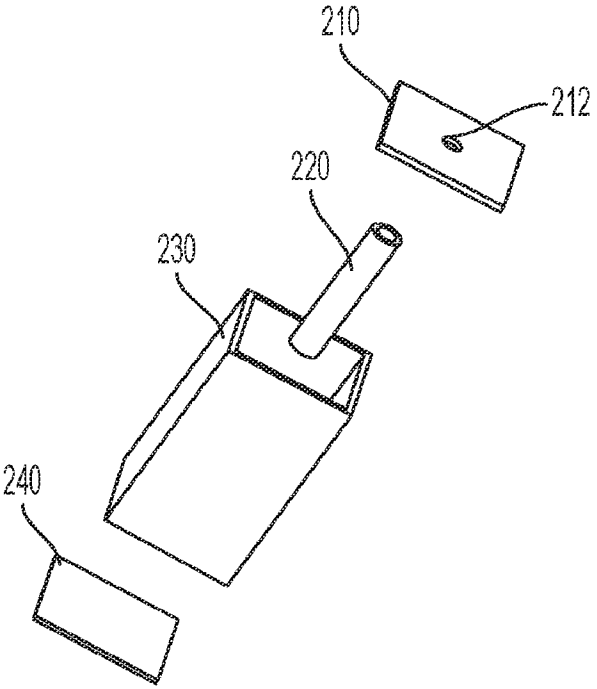
FIG. 3 is an exploded view of a section or super cell of another exemplary embodiment of a sound-absorbing panel.

FIG. 3 shows an example of a unit cell constructed by adding a tube 220 to the openings 212 on veneer panel 210. Tube 220 can extend into cavity section 230, but not so far as to be occluded by backer panel 240. In some embodiments tube 220 may be placed outside of cavity section 230, instead being placed on the outside face of veneer 210, but this may not be aesthetically prudent.

Figure 4:
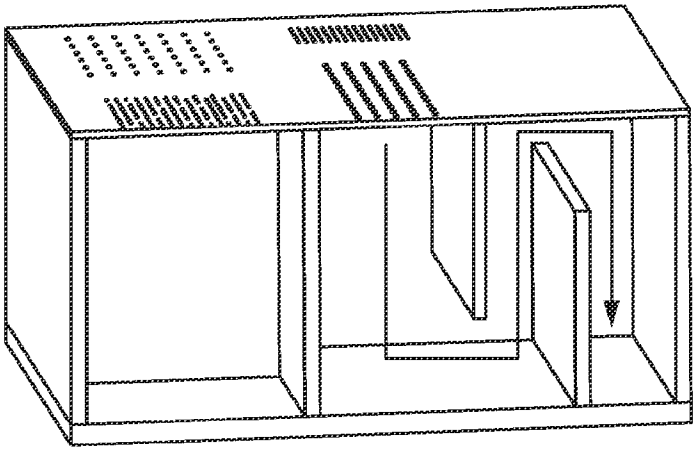
FIG. 4 is a perspective view of a section or super cell of another exemplary embodiment of a sound-absorbing panel.

FIG. 4 is a cross-sectional diagram of another embodiment where multiple baffles may be placed in a resonant cavity to further extend the length. In this example, two opposing baffles are oriented such that the cavity coils perpendicular to the plane of the sound absorbing panel to create a cavity having an effective length roughly three times the panel. It should be appreciated that in some embodiments, the baffles are oriented to coil the resonant cavity in the same plane as the panel (such as shown in FIGS. 1B and 1C with a single baffle). Any number of baffles can be used to achieve the coiled resonant length desired in various embodiments.

Figures 5, 6:
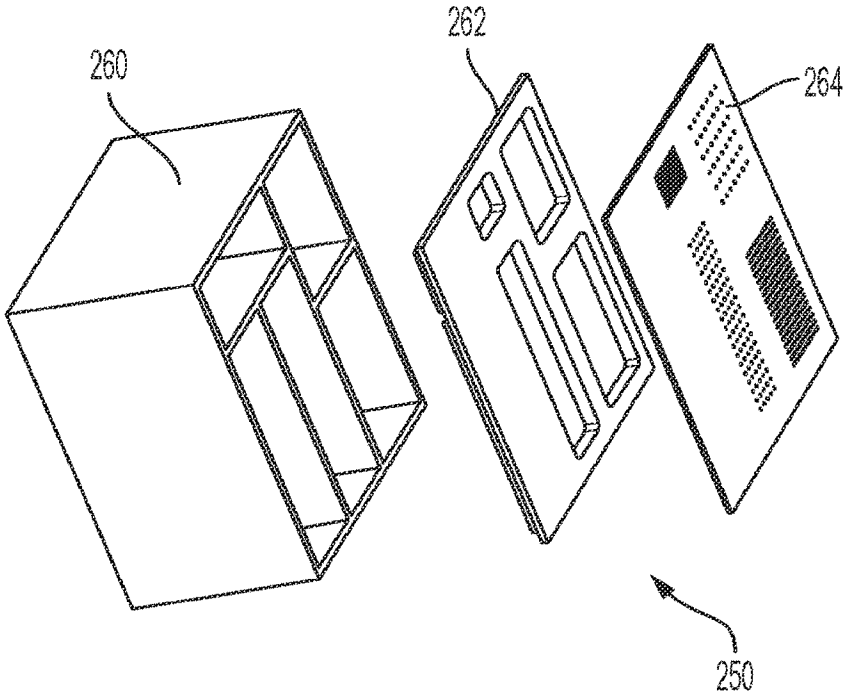
FIG. 5 is an exploded view of a section or super cell of an exemplary embodiment of a sound-absorbing panel.
FIG. 6 is a table of exemplary depths of exemplary embodiments of a sound-absorbing panel.

FIG. 5 is an exploded view of another embodiment 250, similar to that shown in FIG. 1B, having an additional support structure 262 between the cavity section 260 and the veneer layer 264 (backer panel not shown). Support structure 262 can be a rigid layer that provides most of the end wall of each resonant cavity, with gaps sized to accept a veneer layer 264 that provides the groups of openings. This allows veneer layer 264 to be less rigid or more focused on providing the holes that allow communication between the environment and the resonant cavities. In some embodiments layer 264 need not be a continuous sheet. Instead, in some embodiments, veneer layer 264 can include molded or drilled inserts to mate to the openings in support structure 262. Such an embodiment could use the tubular opening concepts shown in FIG. 3, for example.

FIG. 6 is an exemplary table that illustrates exemplary sound absorbing panel depth that may be well suited for a given band of audio frequencies to be damped. The depth is bounded by the law of causality, which dictates the minimum depth allowed for a passive absorber to have a specific absorption spectrum.

For the embodiments described above, the super cells can be arranged in an repeating pattern/array to create a panel having a face of any desired dimensions. The veneer panel can form a continuous face panel across multiple super cells or can form a discrete face panel for each super cell. Each super cell defines a groups of unit cells that are each tuned to a specific frequency response, which generally differs for each unit in the super cell. The cavity section of the panel can include discrete or monolithic components to for each cavity, as described above. Each cavity is comprised of walls that define the three dimensional extents of the cavity and can include one or more baffles to create a coiled resonator. It should be noted that a coiled resonator need not be folded only in one direction or plane. For example, the coiled resonator in FIG. 4 coils in two direction (in a single plane perpendicular to the plane of the face, which is at the top of FIG. 4.)

The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

In addition, even if a specific number is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, sample embodiments, or drawings, should be understood to contemplate the possibilities of including one of the terms, either of the terms, or both terms. For example, the phrase "A or B" will be understood to include the possibilities of "A" or "B" or "A and B."

In addition, where features of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges that can be subsequently broken down into subranges as discussed above. Finally, as will be understood by one skilled in the art, a range includes each individual member. Thus, for example, a group having 1-3 components refers to groups having 1, 2, or 3 components. Similarly, a group having 1-5 components refers to groups having 1, 2, 3, 4, or 5 components, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A sound absorbing panel comprising:

a cavity section having a plurality of resonant cavities each sealed from the others by a partition;

a front panel having a plurality of sets of openings, each set of openings configured to provide fluid communication between one of the plurality of resonant cavities and the environment, where a pair of one of the sets of openings and one of the plurality of resonant cavities defines a sound absorbing cell; and a plurality of super cells, each super cell comprising a group of sound absorbing cells that are in parallel fluid communication with the environment, wherein each of the plurality of resonant cavities of a super cell has different dimensions from the remaining plurality of resonant cavities of the super cell, such that each of the resonant cavities is tuned for a different frequency range.

2. The sound absorbing panel of claim 1, wherein each of the sets of openings differs from the remaining sets of openings in at least one of opening size, length, and distance between openings.

3. The sound absorbing panel of claim 1, wherein at least one of the plurality of resonant cavities comprises outer walls and at least one baffle such that the resonant cavity is coiled.

4. The sound absorbing panel of claim 3, wherein the resonant cavity is coiled parallel to a plane defined by the front panel.

5. The sound absorbing panel of claim 3, wherein the resonant cavity is coiled perpendicular to a plane defined by the front panel.

6. A sound absorbing panel comprising:

a group of sound absorbing cells, each cell within the group comprising a resonant cavity with predetermined dimensions that is sealed by at least one partition from the other cells of the group; and a front panel having a plurality of sets of openings, each set corresponding to a sound absorbing cell and configured to provide fluid communication between the resonant cavity of the cell and the environment, such that each cell in the group is in parallel communication with the environment, wherein the resonant cavity of each of the sound absorbing cells in the group has different dimensions from the remaining plurality of resonant cavities in the group of sound absorbing cells, such that each of the resonant cavities in the group is tuned for a different frequency range.

7. The sound absorbing panel of claim 6, wherein each of the sets of openings differs from the remaining sets of openings in at least one of opening size, length, and distance between openings.

8. The sound absorbing panel of claim 6, wherein at least one of the resonant cavities of the group of cells comprises outer walls and at least one baffle such that the resonant cavity is coiled.

9. The sound absorbing panel of claim 8, wherein the resonant cavity is coiled parallel to a plane defined by the front panel.

10. The sound absorbing panel of claim 8, wherein the resonant cavity is coiled perpendicular to a plane defined by the front panel.

11. A sound absorbing panel comprising:

a cavity section having a plurality of resonant cavities each sealed from the others by a partition;

a front panel having a plurality of sets of openings, each set of openings configured to provide fluid communication between one of the plurality of resonant cavities and the environment;

a back panel that otherwise isolates the plurality of resonant cavities from the environment; and at least one super cell comprising a group of sound absorbing cells in parallel fluid communication with the environment, each cell comprising one of the resonant cavities and one of the plurality of sets of openings, wherein the resonant cavity of each of the of sound absorbing cells in the group has different dimensions from the remaining resonant cavities of the super cell, such that each of the resonant cavities in the group is tuned for a different frequency range.

12. The sound absorbing panel of claim 11, wherein each of the sets of openings differs from the remaining sets of openings in at least one of opening size, length, and distance between openings.

13. The sound absorbing panel of claim 11, wherein at least one of the plurality of resonant cavities comprises outer walls and at least one baffle such that the resonant cavity is coiled.

14. The sound absorbing panel of claim 13, wherein the resonant cavity is coiled parallel to a plane defined by the front panel.

15. The sound absorbing panel of claim 13, wherein the resonant cavity is coiled perpendicular to a plane defined by the front panel.

* * * * *